United States Patent [19]

Willich

[11] 4,259,049

[45] Mar. 31, 1981

[54] TABLETTING MACHINE

[75] Inventor: Rolf Willich, Schwarzenbek, Fed. Rep. of Germany

[73] Assignee: Wilhelm Fette GmbH, Schwarzenbek, Fed. Rep. of Germany

[21] Appl. No.: 134,922

[22] Filed: Mar. 28, 1980

[30] Foreign Application Priority Data

Apr. 7, 1979 [DE] Fed. Rep. of Germany ..... 2914201

[51] Int. Cl.[3] ..... B30B 11/08

[52] U.S. Cl. ..... 425/73; 425/210; 425/353

[58] Field of Search ..... 425/73, 78, 210, 225, 425/226, 345, 352, 353

[56] References Cited

U.S. PATENT DOCUMENTS

| | | | |
|---|---|---|---|
| 1,918,064 | 7/1933 | Taylor | 425/78 X |
| 2,169,281 | 8/1939 | Pfanstiehl | 425/78 |
| 3,128,499 | 4/1964 | Smolenski | 425/225 |
| 3,156,011 | 11/1964 | Olson | 425/78 X |
| 3,599,578 | 8/1971 | Sato et al. | 425/73 X |
| 3,784,343 | 1/1974 | Iwasaki | 425/352 |
| 3,804,570 | 4/1974 | Hoschele et al. | 425/78 X |
| 3,832,107 | 8/1974 | Cox et al. | 425/73 X |
| 3,999,922 | 12/1976 | Shimada | 425/210 X |

FOREIGN PATENT DOCUMENTS

| | | | |
|---|---|---|---|
| 2424655 | 12/1975 | Fed. Rep. of Germany | 425/210 |

*Primary Examiner*—J. Howard Flint, Jr.
*Attorney, Agent, or Firm*—Michael J. Striker

[57] ABSTRACT

A tabletting machine having upper and cooperating lower plungers surrounded at their leading end portions with clearance by elastic cuffs; gas is blown through these cuffs towards the front ends of the plungers to prevent the deposition of dust on the plunger surfaces.

13 Claims, 1 Drawing Figure

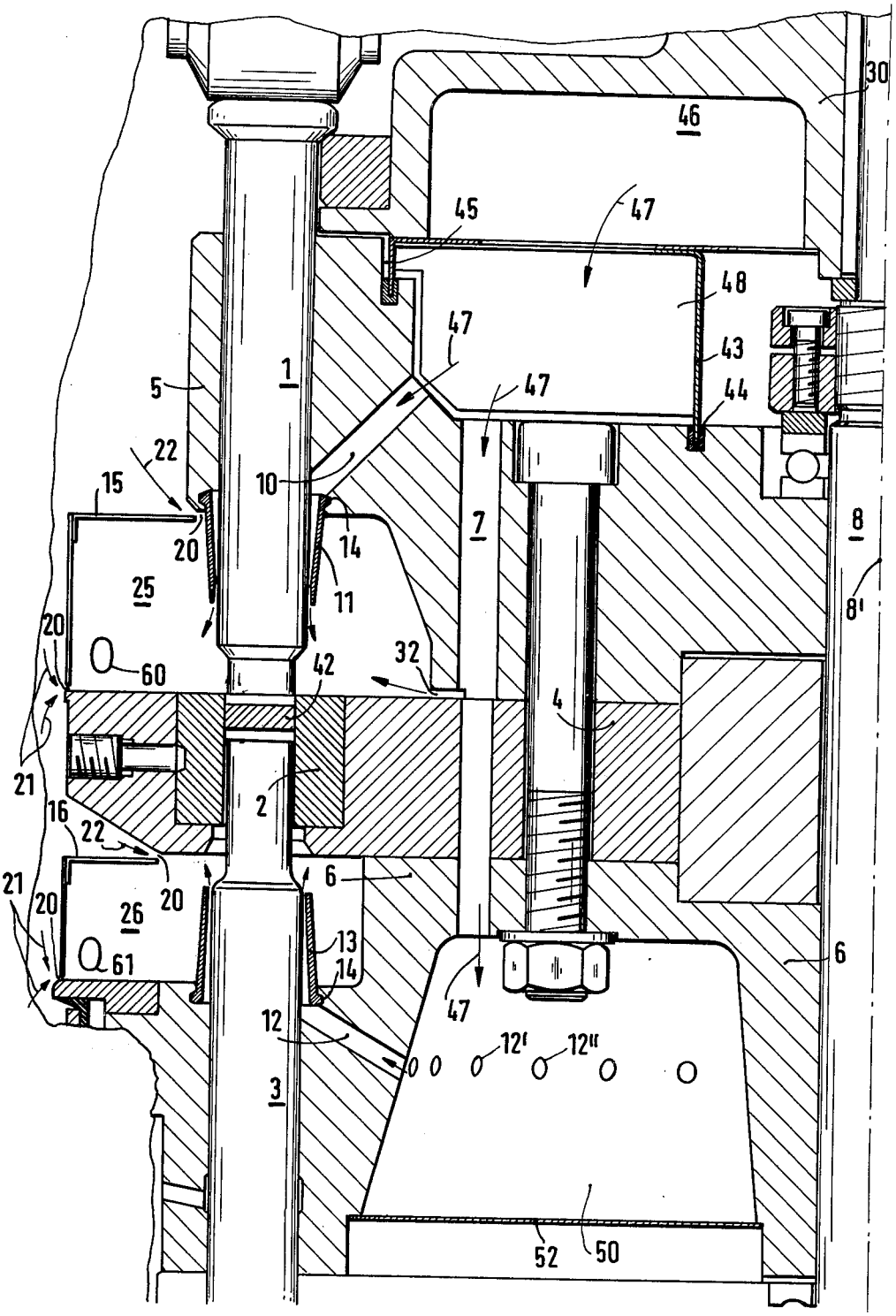
30
46
45
47
48
43
44
47
47
47
1
5
22
15
10
20
14
11
7
8
8'
25
20
60
42
32
4
21
2
16
22
20
6
21
20
26
20
61
13
14
6
47
12
12'
12''
3
52
50

TABLETTING MACHINE

BACKGROUND OF THE INVENTION

The present invention relates to a tabletting machine, i.e., to a machine for compressing pulverulent and similar materials to form tablets (e.g., medication, candy or the like).

The nature of the material handled in tabletting machines makes it impossible to avoid the evolution of powdery dust during admission of the material to be acted upon, as well as during pressing and subsequent ejection of the finished tablets. Those skilled in the art will know the manifold problems arising from this dust evolution. These problems have led to the provision of suction equipment by means of which the dust is to be aspirated and removed.

Generally speaking, this measure is satisfactory in that it alleviates many of the dust-related problems. However, one problem which even this measure does not adequately solve is the deposition of the fine dust on the shafts of the plungers (i.e., the elements which perform the compressing) which reciprocate in plunger guides. During this reciprocation the dust is then carried into the guides and into contact with their guide surfaces which tightly surround the plunger shafts. It is readily evident that the dust, once it reaches this position, will during succeeding reciprocations of the plungers act as an abrasive that wears away the cooperating surfaces of the plunger shafts and plunger guides. Over a period of time this wear becomes so pronounced that the plungers are no longer accurately guided. In addition, the presence of the dust in the plunger guides severely reduces the ease of reciprocation, to such an extent that the plungers—urged by cams or other motion-imparting equipment to reciprocate but seized in the guides due to the presence of the dust—may become damaged.

SUMMARY OF THE INVENTION

Accordingly, it is an object of the invention to overcome the prior-art disadvantages.

A more particular object is to provide a tabletting machine in which the access of dust to the plunger guides is completely or at least substantially prevented.

Pursuant to these objects, and still others which will become apparent hereafter, one aspect of the invention resides in a combination which, briefly stated, may comprise tubular cuffs surrounding with annular clearance those portions of the plungers which move out of the guides during reciprocation; and means for blowing streams of gaseous fluid through the clearances along the respective plungers so as to prevent the deposition of dust on the portion of the plungers and the entry of the thus deposited dust into the respective guides.

The air which is admitted via the cuffs prevents the deposition of dust on the plunger portions which alternately emerge from and retreat into the plunger guides during reciprocation of the plungers. The problems associated with the entry of such dust into the plunger guides are therefore avoided or at least greatly ameliorated.

It would, of course, be no help if the dust were to be simply blown away from the plungers and to a different part of the machine; this would merely shift the contamination from one location to another and create new problems. According to a further concept of the invention it is therefore proposed to have the cuffs surrounded by aspirating chambers each communicating with at least one suction conduit, so that these aspirating chambers may be maintained at subatmospheric pressure. It then becomes possible to remove the admitted air and the dust and to convey them to a location at which the air can be freed of the dust.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE is a fragmentary vertical section through a tabletting machine embodying the invention.

DESCRIPTION OF THE PREFERRED EMBODIMENTS

Before discussing the FIGURE in detail it should be understood that the only partially illustrated machine has a plurality of compressing stations, only one of which is shown, which are all circumferentially spaced about a central upright shaft 8. The shaft 8 may be stationary and the stations turn about the central axis 8' defined by the shaft 8. Since the compressing stations are all the same, illustration of one of them will suffice for an understanding of the invention.

With the above in mind it will be seen that the FIGURE illustrates one compressing station having an upper plunger 1, a lower plunger 3 and a mold or matrix 2 with which the two plungers cooperate. The manner in which pulverulent or similar material is admitted into the matrix 2 for subsequent compression, and the manner in which the finished tablet 42 is expelled from the matrix 2, forms no part of the invention, being known per se in the art. The plungers have respective leading endfaces 1*a*, 3*a* which enter into the cavity of the matrix 2 from opposite ends of the cavity, so as to compress pulverulent material therein between themselves and form the tablet 42.

The matrix 2 is mounted in a matrix table 4 which also mounts the (not illustrated) matrices of the other stations. The plunger 1 is axially reciprocable in a plunger guide 5 and the plunger 3 is similarly axially reciprocable in a plunger guide 6. Again, the guides 5 and 6 also guide the upper and lower plungers (not illustrated) of the other stations. The guides 5, 6, the plungers 1, 3 and the matrix table 4 with matrix 2 are all connected together (known per se) so as to jointly turn about the upright axis 8'.

The purpose of this invention is to avoid the deposition of dust on the plungers 1, 3 and its entry into the guides 5, 6. To achieve this purpose the invention surrounds the forward parts of the plungers 1, 3 with respective cuffs 11, 13 of an elastomeric material, such as natural or synthetic rubber or synthetic plastic material. These cuffs have respective beads or collars 14 which engage in appropriate recesses of the guides 5, 6 so that the cuffs are supported by these guides. The inner cross-section of the tubular cuffs 11, 13 decreases in direction towards the face 1*a*, 3*a* of the respectively associated plunger; in this manner the annular air passage bounded by the cuffs and plungers also decreases so that air flowing towards the respective faces 1*a*, 3*a* is accelerated.

Air supply passages 10, 12 communicate with the upstream ends of the cuffs 11, 13 so that air admitted into the annular air passages of the cuffs 11, 13 flows therethrough, as indicated by the arrows. The air is supplied via an upper air supply chamber 46 which is provided in a stationary upper part 30 serving as the cam carrier of the machine (the cams are not illustrated; they are known per se). From chamber 46 the air (derived from a suitable not-illustrated supply) enters into distribution chamber 48 of part-circular (in top view) outline; the distribution passages 10 branch off from this chamber 48 which is in part bounded by a stationary sheet-material housing. The lower edges of housing 43 extend into oil seals (oil-filled grooves) 44, 45 to effect a seal with reference to the rotating components located beneath the housing 43. A connecting passage 7 extends from the bottom region of chamber 48 into a lower air supply chamber 50 which is also of part-circular outline. The lower end of chamber 50 is closed off by a bottom wall. Air passages 12, 12', 12'' etc. distribute air from chamber 50 to the respective lower plungers 3 (only one shown).

The chambers 48 and 50 could also be formed in the hollow shaft 8 and the passages 10, 12 would then extend about radially to the respective plungers 1, 3. However, the generally segment-shaped (part-circular) chambers 48 (one shown) of which each supplies several of the plungers as illustrated, are currently preferred. These chambers could also service the lower plungers 3, in lieu of the provision of the lower chamber 50. The exit openings at which the passages 10, 12 discharge air into the cuffs 11, 13 are centered on the longitudinal axes of the plungers 1, 3, respectively. However, such centering is not absolutely necessary and may be dispensed with if, for example, a circulating air flow or increased air turbulence is to be produced in the air gaps of the cuffs 11, 13.

The air admitted via the cuffs 11, 13 blows along the exposed parts of the plunger shafts, i.e., those parts which in operation become exposed outside the guides 5, 6 and thus prevents the deposition of dust on these parts which during the reciprocation, could be carried into the guides 5, 6. It is, of course, not desired that this dust now be blown by the air to another part of the machine, there to create new problems. To avoid this, the machine is provided with suction chambers 25 and 26 which surround the cuffs 11, 13 and the exposed parts of the plungers. The chamber 25 is defined by the guide 5 and a stationary hood or cover 15, and the chamber 26 is defined by the guide 6 and a stationary hood or cover 16. Unlike the chambers for the incoming air, the suction chambers 25, 26 are not sealed. Instead, openings or gaps 20 are provided at the juncture of the edges of covers 15, 16 with the guides 5, 6. Thus, the suction produced in the chambers 25, 26 via the suction channels 60, 61 (leading to any known-per-se source of suction) causes not only the dust and the air from cuffs 11, 13 to be withdrawn through the channels 60, 61, but also causes ambient air to be aspirated through the gaps 20 (see arrows 21, 22) so that an escape of dust is prevented without special seals even with the covers 15, 16 being stationary relative to the other, rotating components.

An air-inlet passage 32 communicates with the chamber 25 at the bottom thereof (it need, however, not be located at the bottom). Its purpose is to prevent the deposition of dust on or in the region of the face 1*a* of plunger 1 and on the upper surface of the matrix table 4.

It is a particular advantage of the invention that it not only serves to prevent the previously identified dust problems, but can additionally be used to cool parts of the machine, especially the plungers which tend to heat up. All that is required to obtain this additional function is to cool the incoming air (instrumentalities for this are known per se). The term "air" as used herein can, of course, refer to air in all its forms, i.e., including air which has been pretreated to remove moisture and make it dry, as well as to any suitable gases.

While the invention has been illustrated and described as embodied in a tabletting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. In a tabletting machine having reciprocating plungers mounted for reciprocation in respective guides, a combination comprising tubular cuffs surrounding with annular clearance those portions of the plungers which move out of the guides during reciprocation; and means for blowing streams of gaseous fluid through said clearances along the respective plungers so as to prevent the deposition of dust on said portions of the plungers and the entry of the thus deposited dust into the respective guides.

2. A combination as defined in claim 1; and further comprising means, including chambers surrounding said cuffs, for removing the dust which has been prevented from deposition on the plungers.

3. A combination as defined in claim 2, said removing means including suction passages communicating with said chambers for aspirating dust from the same.

4. A combination as defined in claim 3, said chambers being in part bounded by covers, and said covers defining openings through which said chambers communicate with the ambient atmosphere so that ambient air is drawn through said openings.

5. A combination as defined in claim 2; further comprising means communicating with at least some of said chambers near a bottom wall thereof, for admitting air under pressure into the same so as to prevent the deposition of dust on said bottom wall.

6. A combination as defined in claim 1, said blowing means comprising fluid-distributing chambers and passages connecting said chambers with the respective cuffs.

7. A combination as defined in claim 6, said plungers including upper plungers and cooperating lower plungers; and wherein said distributing chambers comprise upper and lower distributing chambers which communicate with the cuffs of the upper and lower plungers, respectively.

8. A combination as defined in claim 7, said blowing means further comprising at least one connecting passage between the respective upper and lower distributing chambers.

9. A combination as defined in claim 1, said blowing means comprising fluid passages each having an outlet communicating with one of said annular clearances and directed at a central axis thereof.

10. A combination as defined in claim 1, said blowing means comprising fluid passages each having an outlet communicating with one of said annular clearances and directed laterally of a central axis thereof.

11. A combination as defined in claim 1; and further comprising means for cooling said gaseous fluid.

12. A combination as defined in claim 1, said cuffs being of an elastomeric material and having axially spaced end portions one of which is provided with an annular collar engageable in a recess of a respective one of said guides.

13. A combination as defined in claim 1, said plungers having leading ends, and said cuffs having an inner diameter which decreases in direction towards the leading end of the associated plunger.

* * * * *